US010451330B2

(12) United States Patent
Yanagisawa et al.

(10) Patent No.: US 10,451,330 B2
(45) Date of Patent: Oct. 22, 2019

(54) AUTOMATIC VENDING MACHINE

(71) Applicants: SANDEN HOLDINGS CORPORATION, Isesaki-shi (JP); THE COCA-COLA COMPANY, Atlanta, GA (US)

(72) Inventors: Yuuki Yanagisawa, Isesaki (JP); Yasuhiro Yamazaki, Koto-ku (JP); Takashi Nishiyama, Koto-ku (JP)

(73) Assignees: SANDEN HOLDINGS CORPORATION, Gunma (JP); THE COCA-COLA COMPANY, Atlanta, GA (US)

( * ) Notice: Subject to any disclaimer, the term of this patent is extended or adjusted under 35 U.S.C. 154(b) by 144 days.

(21) Appl. No.: 15/537,736

(22) PCT Filed: Dec. 1, 2015

(86) PCT No.: PCT/JP2015/083691
§ 371 (c)(1),
(2) Date: Jun. 19, 2017

(87) PCT Pub. No.: WO2016/098573
PCT Pub. Date: Jun. 23, 2016

(65) Prior Publication Data

US 2018/0274842 A1 Sep. 27, 2018

(30) Foreign Application Priority Data

Dec. 19, 2014 (JP) ..... 2014-257970

(51) Int. Cl.
*E04H 7/22* (2006.01)
*F25D 17/06* (2006.01)
(Continued)

(52) U.S. Cl.
CPC ..... *F25D 17/06* (2013.01); *F25D 17/08* (2013.01); *F25D 29/005* (2013.01);
(Continued)

(58) Field of Classification Search
CPC ..... F25D 17/08; F25D 31/007
(Continued)

(56) References Cited

FOREIGN PATENT DOCUMENTS

| | | |
|---|---|---|
| EP | 2782077 | 9/2014 |
| JP | 56-159877 | 11/1981 |

(Continued)

OTHER PUBLICATIONS

Preliminary Report on Patentability dated Jun. 29, 2017 which issued in the corresponding International Patent Application No. PCT/JP2015/083691.

(Continued)

*Primary Examiner* — Helena Kosanovic
(74) *Attorney, Agent, or Firm* — Cozen O'Connor

(57) ABSTRACT

Automatic vending machine which cools products for sale. Sale of products not in an appropriate temperature state is prevented. A cooling device executes a partial cooling operation for cooling the product located on a lower side of the plurality of products stored in a product storage chamber when lower space temperature T1 inside the chamber becomes higher than upper-limit value $TS_u$ of set temperature range (S1→S2). Then, when the lower space temperature T1 is decreased to a lower-limit value $TS_L$ of the set temperature range, the automatic vending machine executes an entire cooling operation for cooling all the plurality of products (S3→S4). Furthermore, when the lower space temperature T1 becomes higher than upper-limit value $TS_u$ of the set temperature range during execution of the entire cooling operation, the automatic vending machine stops the
(Continued)

entire cooling operation to execute the partial cooling operation (S5→S6).

4 Claims, 10 Drawing Sheets

(51) Int. Cl.

| | |
|---|---|
| ***F25D 17/08*** | (2006.01) |
| ***F25D 31/00*** | (2006.01) |
| ***G07F 9/10*** | (2006.01) |
| ***F25D 29/00*** | (2006.01) |

(52) U.S. Cl.
CPC ..... *F25D 31/007* (2013.01); *G07F 9/105* (2013.01); *F25D 2317/063* (2013.01); *F25D 2317/067* (2013.01); *F25D 2317/0682* (2013.01); *F25D 2317/0684* (2013.01); *F25D 2331/803* (2013.01); *F25D 2331/805* (2013.01); *F25D 2700/12* (2013.01)

(58) Field of Classification Search
USPC ..... 454/183
See application file for complete search history.

(56) References Cited

FOREIGN PATENT DOCUMENTS

| | | |
|---|---|---|
| JP | 62-026515 | 6/1987 |
| JP | 08-171672 | 7/1996 |
| JP | 09-245237 | 9/1997 |
| JP | 2011-53857 | 3/2011 |
| JP | 2013-196105 | 9/2013 |
| JP | 2013-196113 | 9/2013 |

OTHER PUBLICATIONS

Search Report dated Jul. 18, 2018 which issued in the corresponding European Patent Application No. 15869781.3.
Examination Report dated Oct. 11, 2018 issued in the corresponding Australian Patent Application No. 2015365008.
Office Action dated Jan. 2, 2018 which issued in the corresponding Australian Patent Application No. 2015365008.
Office Action dated Dec. 25, 2018 issued in Chinese Patent Application No. 201580068954.9.
Office Action dated Jan. 22, 2019 issued in Japanese Patent Application No. 2014-257970.

T1 LOWER SPACE TEMPERATURE INSIDE PRODUCT STORAGE CHAMBER
$TS_U$ UPPER-LIMIT VALUE OF SET TEMPERATURE RANGE TS
$TS_L$ LOWER-LIMIT VALUE OF SET TEMPERATURE RANGE TS

T1 LOWER SPACE TEMPERATURE INSIDE PRODUCT STORAGE CHAMBER
$TS_U$ UPPER-LIMIT VALUE OF SET TEMPERATURE RANGE TS
$TS_L$ LOWER-LIMIT VALUE OF SET TEMPERATURE RANGE TS
ΔT1 INCREASED VALUE OF LOWER SPACE TEMPERATURE T1
dTS DETERMINED VALUE

T1 LOWER SPACE TEMPERATURE INSIDE PRODUCT STORAGE CHAMBER
T2 UPPER SPACE TEMPERATURE INSIDE PRODUCT STORAGE CHAMBER
$TS_U$ UPPER-LIMIT VALUE OF SET TEMPERATURE RANGE TS
$TS_L$ LOWER-LIMIT VALUE OF SET TEMPERATURE RANGE TS

AUTOMATIC VENDING MACHINE

RELATED APPLICATIONS

This is a U.S. National Phase Application under 35 USC 371 of International Application PCT/JP2015/083691 filed on Dec. 1, 2015.

This application claims the priority of Japanese application no. 2014-257970 filed Dec. 19, 2014, the entire content of which is hereby incorporated by reference.

TECHNICAL FIELD

The present invention relates to an automatic vending machine which cools products for sale.

BACKGROUND ART

An automatic vending machine has conventionally been known which controls vicinity of a lowermost part and an upper part of a product storage column at different temperatures. The automatic vending machine includes: a damper which selectively makes cool air, generated by a cooling mechanism, pass through either of the vicinity of the lowermost part and the upper part of the product storage column; a first temperature measuring device which measures a temperature of the vicinity of the lowermost part of the product storage column; a second temperature measuring device which measures a temperature of the upper part of the product storage column; driving device adapted to drive the cooling mechanism when measuring a second cooling control temperature or higher by the second temperature measuring device; and damper control device adapted to control the damper so as to make the cool air pass through the upper part of the product storage column only when measuring a first cooling control temperature (which is less than the second cooling control temperature) or lower by the first temperature measuring device (see Patent Document 1).

REFERENCE DOCUMENT LIST

Patent Document

Patent Document 1: Japanese Examined Patent Application Publication No. S62-26515

SUMMARY OF THE INVENTION

Problem to be Solved by the Invention

However, the conventional automatic vending machine drives the cooling mechanism based on the temperature of the upper part of the product storage column. Thus, for example, upon sale of products having a narrow appropriate temperature range or permitted temperature range, a temperature of the product located in the vicinity of the lowermost part of the product storage column, that is, the product which is soon to be sold, deviates from the appropriate temperature range or the permitted temperature range, and therefore, there is a possibility that a product that is not at an appropriate temperature will be sold.

Thus, it is an object of the present invention to prevent sale of products which are not in an appropriate temperature state especially upon sale of the products having a narrow appropriate temperature range or permitted temperature range in an automatic vending machine which cools products for sale.

Means for Solving the Problems

According to one aspect of the present invention, an automatic vending machine which vertically arrays and stores a plurality of products inside a product storage chamber and sequentially dispenses the products starting with the product located at a lowermost part includes: a cooling device which cools the inside of the product storage chamber; a lower part temperature measuring unit which measures a temperature of a lower space inside the product storage chamber; and a control unit which controls operation of the cooling device and is capable of selectively executing partial cooling operation for cooling the product located on a lower side of the plurality of products and entire cooling operation for cooling all the plurality of products. When the temperature of the lower space inside the product storage chamber becomes higher than a set temperature range, the control unit executes the partial cooling operation to maintain the temperature of the lower space inside the product storage chamber within the set temperature range.

Effects of the Invention

The automatic vending machine executes the partial cooling operation when the temperature of the lower space inside the product storage chamber becomes higher than the set temperature range, so that the temperature of the lower space inside the product storage chamber is maintained within the set temperature range. Thus, the product located on a lower side of the plurality of products stored in the product storage chamber, that is, the product to be sold next time or the product which will be sold with a high probability is held in an appropriate temperature state. Consequently, sale of products not in an appropriate temperature state is prevented.

MODE FOR CARRYING OUT THE INVENTION

Hereinafter, an embodiment of the present invention will be described with reference to the accompanying drawings.

Figure 1:
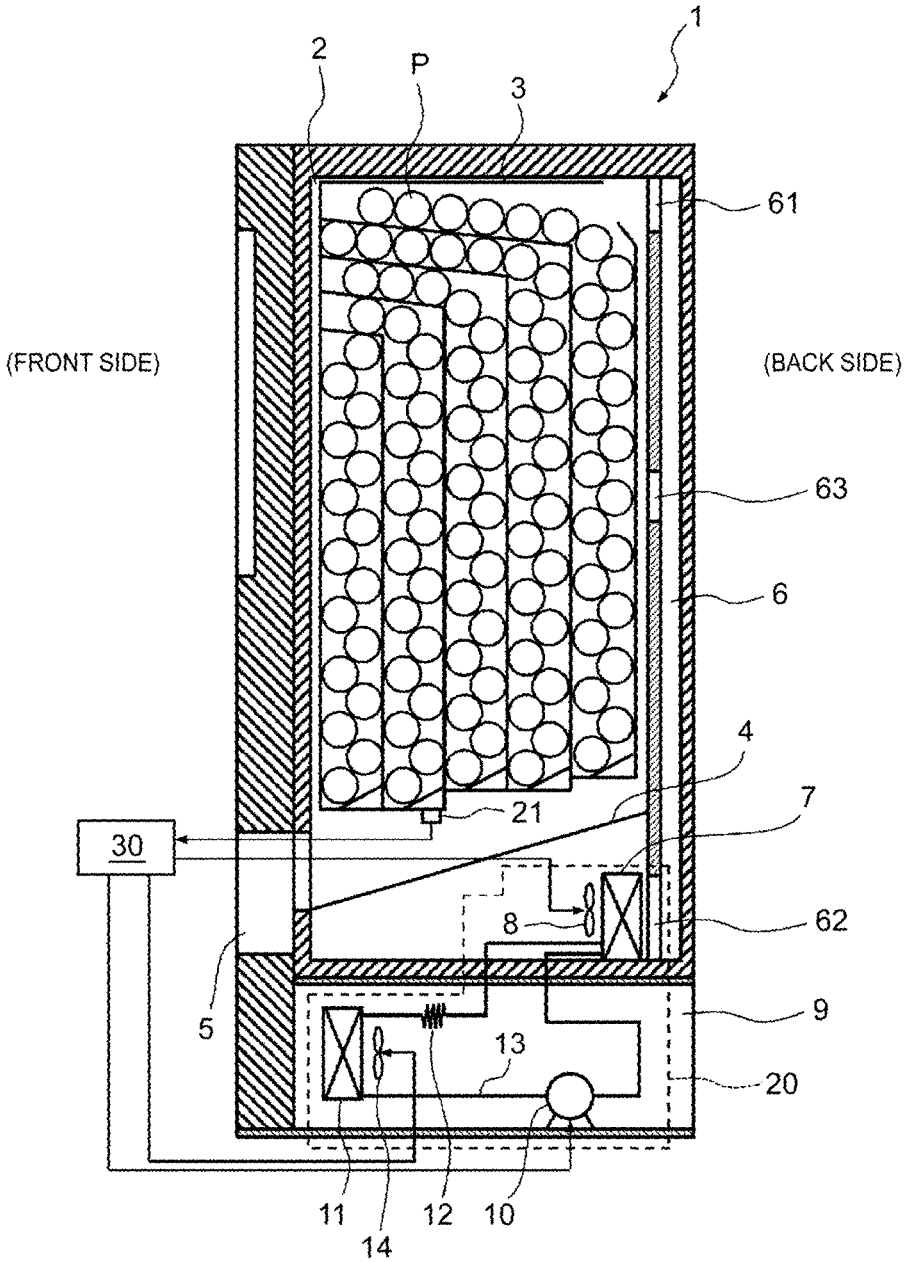
FIG. 1 is a side sectional view of an automatic vending machine according to one embodiment of the present invention.

FIG. 1 is a side sectional view of an automatic vending machine according to one embodiment of the invention. An automatic vending machine 1 according to the present embodiment is configured to be able to cool bottled beverages (beverages contained in plastic bottles here) P as products for sale, and has therein a product storage chamber 2 with a heat-insulated structure. Inside the product storage chamber 2, a product storage device 3 having a plurality of product storage columns (here, five product storage columns) in an anteroposterior direction is disposed. The product storage device 3 vertically arrays and stores the plurality of (a large number of) bottled beverages P of the same type in each product storage column. Furthermore, each product storage column is provided with a product discharge mechanism which sequentially discharges the bottled beverages P starting with the bottled beverage P located at a lowermost part.

A product shooter 4 is provided below the product storage device 3 inside the product storage chamber 2. The product shooter 4 is formed of a flat plate-like member having a large number of air holes and disposed inclined so as to extend downward from a back side towards a front side of the automatic vending machine 1. Then the automatic vending machine 1 is configured so that, for example, when pressing a product selection button, not illustrated, the product storage device 3 may discharge the bottled beverage P located at the lowermost part of the corresponding product storage column and the discharged bottled beverage P is guided to a product dispense port 5 by the product shooter 4.

A back-side duct 6 which vertically extends is disposed inside the product storage chamber 2 on a back side thereof. The back-side duct 6 extends from vicinity of a bottom part to vicinity of a ceiling part inside the product storage chamber 2, and has: an upper opening part 61 which opens at an upper part inside the product storage chamber 2; a lower opening part 62 which opens at a lower part inside the product storage chamber 2; and a middle opening part 63 which opens between the upper opening part 61 and the lower opening part 62. In the present embodiment, the upper opening part 61 is formed so as to be located in the vicinity of the ceiling part inside the product storage chamber 2, the lower opening part 62 is formed so to be located below the product shooter 4, and the middle opening part 63 is formed so as to be located at a middle height position of the product storage device 3.

An internal heat exchanger (evaporator) 7 and an internal blower fan 8 are provided at a lower part inside the product storage chamber 2, more specifically, below the product shooter 4. The internal heat exchanger 7 is disposed in vicinity of the lower opening part 62 of the back-side duct 6. The internal blower fan 8 is a fan capable of rotating in normal and reverse directions and is disposed in vicinity of the internal heat exchanger 7. Note that the internal heat exchanger 7 is arranged at a position between the lower opening part 62 of the back-side duct 6 and the internal blower fan 8; however, the internal blower fan 8 may be arranged at a position between the lower opening part 62 of the back-side duct 6 and the internal heat exchanger 7. Moreover, the internal heat exchanger 7 and/or the internal blower fan 8 may be disposed inside the back-side duct 6.

Inside a mechanical compartment 9 located on a lower side of the product storage chamber 2, a compressor 10, an external heat exchanger (a condenser or a gas cooler) 11, and an expansion mechanism (capillary tube) 12 are disposed. Note that the expansion mechanism 12 may be disposed inside the product storage chamber 2. The internal heat exchanger 7, the compressor 10, the external heat exchanger 11, and the expansion mechanism 12 are connected together with a cooling pipe 13 which circulates a refrigerant. Moreover, an external blower fan 14 which sends airflow to the external heat exchanger 11 is disposed in vicinity of the external heat exchanger 11. Then, in the present embodiment, the internal heat exchanger 7, the internal blower fan 8, the compressor 10, the external heat exchanger 11, the expansion mechanism 12, and the external blower fan 14 form a cooling device 20 which cools the inside of the product storage chamber 2.

The cooling device 20 circulates the air inside the product storage chamber 2 through the back-side duct 6 by the internal blower fan 8 and also circulates the refrigerant through the compressor 10, the external heat exchanger 11, the expansion mechanism 12, and the internal heat exchanger 7. The air inside the product storage chamber 2 is heat-exchanged with the refrigerant when passing through surroundings of the internal heat exchanger 7 to be cooled. Then, the inside of the product storage chamber 2 and eventually the plurality of bottled beverages P stored in each product storage column of the product storage device 3 are cooled. Therefore, the internal heat exchanger 7 corresponds to "a cooler" of the present invention, and the internal blower fan 8 corresponds to "a circulating fan" of the present invention.

Furthermore, in the present embodiment, a temperature sensor (temperature measuring unit) 21 is provided at a bottom part of the product storage device 3. The temperature sensor 21 measures a temperature of vicinity of the bottled beverage P stored at a lowermost part in the product storage device 3, in other words, a temperature of a lower space (a lower space temperature T1) inside the product storage chamber 2. Note that the temperature sensor 21 is only required to measure the lower space temperature T1 inside the product storage chamber 2, and an installation position of the temperature sensor 21 is not limited to the bottom part of the product storage device 3.

Operation of the cooling device 20 is controlled by a control unit (control section) 30. In the present embodiment, the product storage chamber 2 is configured so as to function as a supercooling chamber of which the inside is capable of being cooled by the cooling device 20 to cool the bottled beverages P, stored in the product storage device 3, in a supercooled state. Thus, the control unit 30 controls the operation of the cooling device 20 so that a temperature of the inside of the product storage chamber 2 may be held at a set temperature range TS in which the bottled beverages P are cooled and held in the supercooled state. Note that the set temperature range TS is a temperature equal to or less than a freezing point of the bottled beverages P, and it is possible to set the temperature at, for example, approximately "−5° C.±3° C.".

Here, the set temperature range TS of the inside of the product storage chamber 2 of the automatic vending machine 1 in the present embodiment is lower and has a narrower range than a set temperature range TS of conventional typical automatic vending machines. In other words, an appropriate temperature range or a permitted temperature range of the bottled beverages P as products is narrower than an appropriate temperature range or a permitted temperature range of the conventional automatic vending machines. Therefore, the automatic vending machine 1 in the present embodiment requires more detailed management of the temperature of the inside of the product storage chamber 2 than the conventional typical automatic vending machines. More specifically, it is required to prevent, as much as possible, occurrence of a situation in which the bottled beverage P not in an appropriate state, here, the bottled beverage P not in the supercooled state (including the bottled beverage P in a frozen state) are sold. Thus, the control unit 30 controls the operation of the cooling device 20 in a manner described below.

In the present embodiment, the control unit 30 reads in the lower space temperature T1 inside the product storage chamber 2, measured by the temperature sensor 21, at a predetermined cycle during running of the automatic vending machine 1, and drives the cooling device 20, when necessary, to selectively execute partial cooling operation or the entire cooling operation. The partial cooling operation is executed mainly for cooling the bottled beverages P stored on a lower side in each product storage column of the product storage device 3, while the entire cooling operation is executed for cooling all the bottled beverages P stored in the product storage device 3. More specifically, when the lower space temperature T1 becomes higher than the set temperature range TS, the control unit 30 executes the partial cooling operation to maintain the lower space temperature T1 within the set temperature range TS, thereby holding the bottled beverages P on the lower side in a supercooled state (appropriate state). Moreover, the control unit 30 executes the entire cooling operation while maintaining the lower space temperature T1 within the set temperature range TS to thereby put the bottled beverages P, other than the bottled beverages P located on the lower side, in a supercooled state or a state close thereto.

Figure 2:
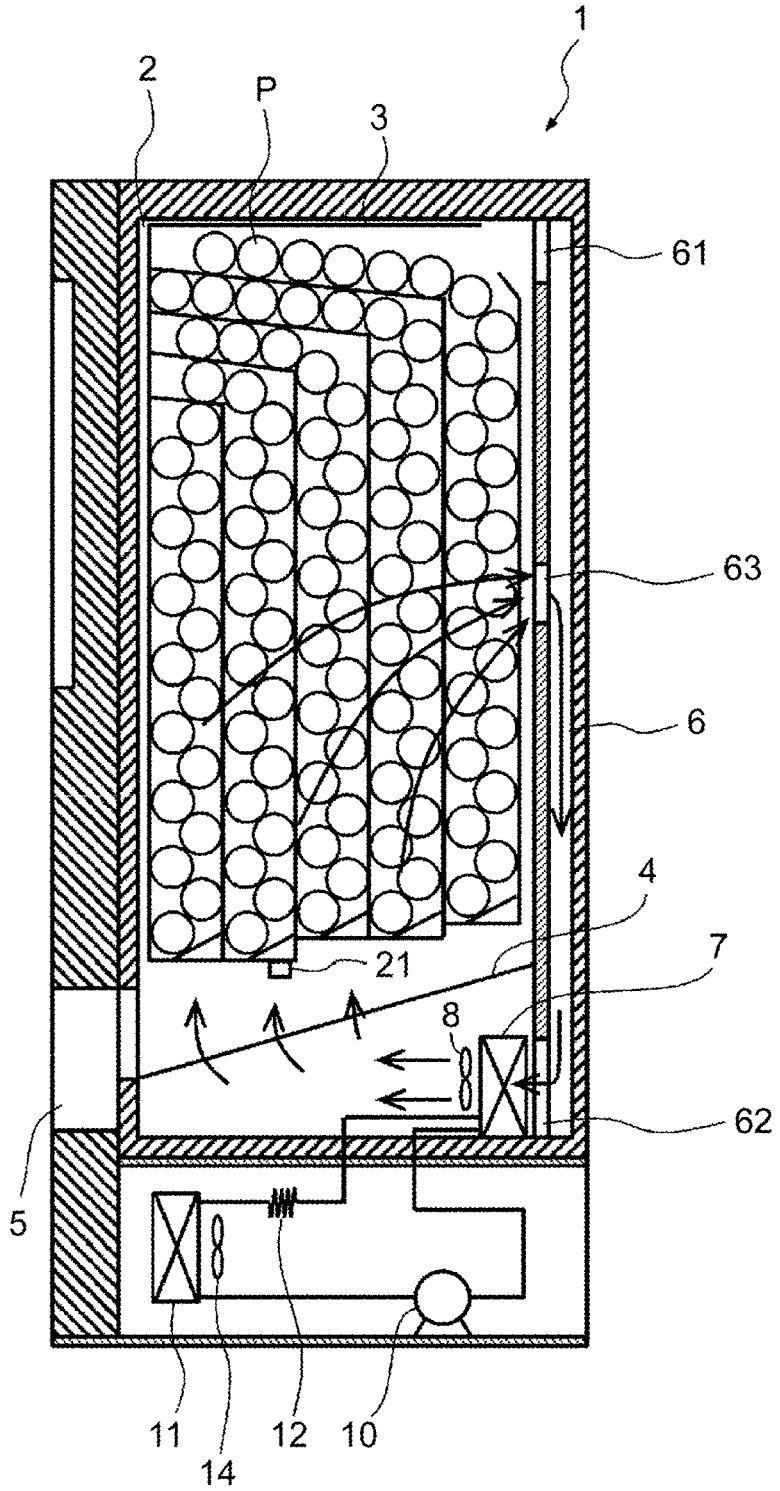
FIG. 2 is a view illustrating an air flow inside a product storage chamber upon partial cooling operation performed in the automatic vending machine.

To execute the partial cooling operation, the control unit 30 drives the internal blower fan 8 into normal rotation and also actuates the compressor 10 and the external blower fan 14. Then, as illustrated in FIG. 2, the air inside the product storage chamber 2 circulates through the inside of the product storage chamber 2 in a manner so as to flow into the back-side duct 6 from the middle opening part 63, downwardly pass through an inside of the back-side duct 6, flow out from the lower opening part 62, and then flow into the back-side duct 6 from the middle opening part 63 again. In this case, the air that flows out from the lower opening part 62 is cooled by the internal heat exchanger 7, passes between the bottled beverages P stored in the product storage device 3 from a bottom to a top, and travels towards the middle opening part 63 again. Therefore, the plurality of (for example, 10 to 15) bottled beverages P stored on the lower side in each product storage column of the product storage device 3 are cooled (the lower space inside the product storage chamber 2 is also cooled simultaneously).

Figure 3:
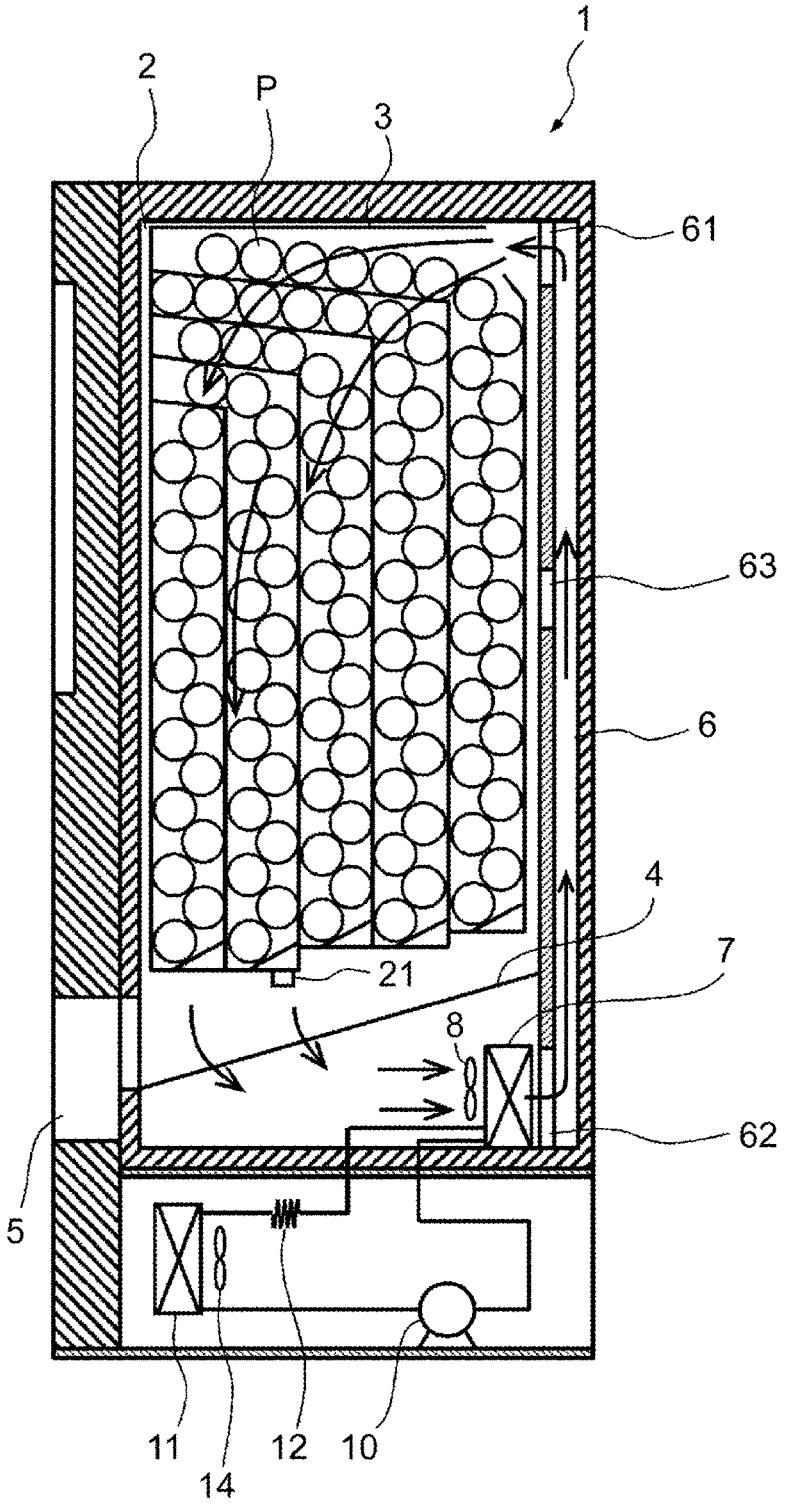
FIG. 3 is a view illustrating an air flow inside the product storage chamber upon entire cooling operation performed in the automatic vending machine.

On the other hand, to execute the entire cooling operation, the control unit 30 drives the internal blower fan 8 into reverse rotation and also actuates the compressor 10 and the external blower fan 14. Then, as illustrated in FIG. 3, the air inside the product storage chamber 2 circulates through the inside of the product storage chamber 2 in a manner so as to flow into the back-side duct 6 from the lower opening part 62, upwardly pass through the inside of the back-side duct 6, flow out from the upper opening part 61, and then flow into the back-side duct 6 from the lower opening part 62 again. That is, the air inside the product storage chamber 2 circulates in a direction opposite to a direction in case of the partial cooling operation. In this case, the air cooled by the internal heat exchanger 7 passes through the back-side duct 6, flows out from the upper opening part 61, passes between the bottled beverages P stored in each product storage column of the product storage device 3 from a top to a bottom, is cooled by the internal heat exchanger 7, and then travels towards the lower opening part 62 again. As a result, all the bottled beverages P stored in the product storage device 3 are cooled (the entire inside of the product storage chamber 2 is also cooled simultaneously).

Figure 4:
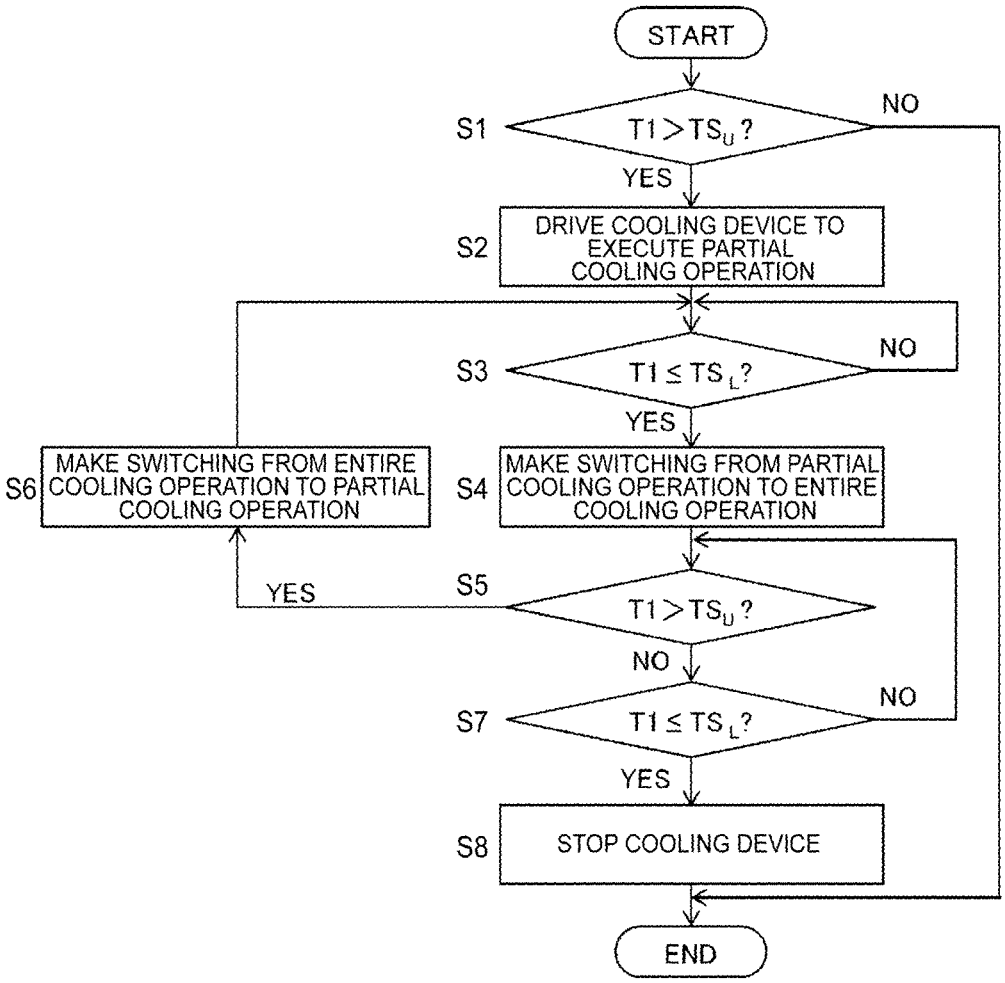
FIG. 4 is a flowchart illustrating one example of operation control of a cooling device performed by the automatic vending machine.

FIG. 4 is a flowchart illustrating one example of operation control of the cooling device 20 executed by the control unit 30. The flowchart is executed at a predetermined cycle while the cooling device 20 is stopped.

In step S1, the control unit 30 determines whether or not the lower space temperature T1 inside the product storage chamber 2 becomes higher than an upper-limit value $TS_u$ of the set temperature range TS, that is, whether or not the lower space temperature T1>the upper-limit value $TS_u$. The process proceeds to step S2 when the lower space temperature T1 becomes higher than the upper-limit value $TS_u$ of the set temperature range TS (when the lower space temperature T1>the upper-limit value $TS_u$), and the present flow is terminated when the lower space temperature T1 is equal to or less than the upper-limit value $TS_u$ of the set temperature range TS (when the lower space temperature T1≤the upper-limit value $TS_u$).

In step S2, the control unit 30 drives the cooling device 20 to execute the partial cooling operation (see FIG. 2). More specifically, as described above, the control unit 30 drives the internal blower fan 8 into normal rotation and actuates the compressor 10 and the external blower fan 14.

In step S3, the control unit 30 determines whether or not the lower space temperature T1 inside the product storage chamber 2 is decreased to a lower-limit value $TS_L$(<the upper-limit value $TS_u$) of the set temperature range TS, that is, whether or not the lower space temperature T1≤the lower-limit value $TS_L$. The process proceeds to step S4 when the lower space temperature T1 is decreased to the lower-limit value $TS_L$ of the set temperature range TS (the lower space temperature T1≤the lower-limit value $TS_L$), and the control unit 30 continues the partial cooling operation when the lower space temperature T1 has not decreased to the lower-limit value $TS_L$ of the set temperature range TS (the lower space temperature T1>the lower-limit value $TS_L$ of the set temperature range TS).

In step S4, the control unit 30 makes switching from the partial cooling operation (see FIG. 2) to the entire cooling operation (see FIG. 3). More specifically, the control unit 30 drives the internal blower fan 8 into reverse rotation to thereby make the switching from the partial cooling operation to the entire cooling operation.

In step S5, as in step S1, the control unit 30 determines whether or not the lower space temperature T1 inside the product storage chamber 2 becomes higher than the upper-limit value $TS_u$ of the set temperature range TS. When the lower space temperature T1 becomes higher than the upper-limit value $TS_u$ of the set temperature range TS (the lower space temperature T1>the upper-limit value $TS_u$), the process proceeds to step S6 to make switching from the entire cooling operation to the partial cooling operation, and then returns to step S3. More specifically, in step S6, the control unit 30 switches the internal blower fan 8 from the reverse rotation to the normal rotation. Then, the entire cooling operation is stopped to execute the partial cooling operation again. On the other hand, when the lower space temperature T1 is equal to or less than the upper-limit value $TS_u$ of the set temperature range TS (the lower space temperature T1≤the upper-limit value $TS_u$), the process proceeds to step S7.

Upon switching from the partial cooling operation to the entire cooling operation, the air in an upper space inside the product storage chamber 2 moves to the lower space. Since a temperature of the air in the upper space is normally higher than a temperature of the air in the lower space, the switching from the partial cooling operation to the entire cooling operation may cause the lower space temperature T1 to increase to become higher than the upper-limit value $TS_u$ of the set temperature range. When the increase in the lower space temperature T1 becomes higher than the upper-limit value $TS_u$ of the set temperature range, there is a possibility that the bottled beverage not in a supercooled state may be sold, which is not preferable. Thus, the control unit 30 monitors the lower space temperature T1 even during the execution of the entire cooling operation, and executes the partial cooling operation again when the lower space temperature T1 inside the product storage chamber 2 becomes higher than the upper-limit value $TS_u$ of the set temperature range TS (step S5→S6), thereby promptly returning the increased lower space temperature T1 to within the set temperature range TS.

In step S7, as in step S3, the control unit 30 determines whether or not the lower space temperature T1 inside the product storage chamber 2 is decreased to the lower-limit value $TS_L$ of the set temperature range TS, that is, the lower space temperature T1≤the lower-limit value $TS_L$. When the lower space temperature T1 is decreased to the lower-limit value $TS_L$ of the set temperature range TS (the lower space temperature T1≤the lower-limit value $TS_L$), the process proceeds to step S8, and when the lower space temperature T1 has not decreased to the lower-limit value $TS_L$ of the set temperature range TS (the lower space temperature T1>the lower-limit value $TS_L$ of the set temperature range TS), the process returns to step S5 (continues the entire cooling operation).

In step S8, the control unit 30 stops the cooling device 20. More specifically, the control unit 30 stops the internal blower fan 8, the compressor 10, and the external blower fan 14.

In the present embodiment, the control unit 30 drives the cooling device 20 to execute the partial cooling operation when the lower space temperature T1 inside the product storage chamber 2 has become higher than the upper-limit value $TS_u$ of the set temperature range TS. Then the control unit 30 executes the entire cooling operation when the lower space temperature T1 inside the product storage chamber 2 is decreased to the lower-limit value $TS_L$ of the set temperature range TS due to the execution of the partial cooling operation. Moreover, the control unit 30 stops the entire cooling operation to execute the partial cooling operation again when the lower space temperature T1 inside the product storage chamber 2 becomes higher than the upper-limit value $TS_u$ of the set temperature range TS during the execution of the entire cooling operation, and stops the cooling device 20 when the lower space temperature T1 inside the product storage chamber 2 is decreased to the lower-limit value $TS_L$ of the set temperature range TS during the execution of the entire cooling operation.

Thus, the lower space temperature T1 inside the product storage chamber 2 is maintained within the range of the set temperature range TS, and the bottled beverages P stored on the lower side in each product storage column of the product storage device 3, that is, the bottled beverages P which are to be sold next time or may be sold with a high probability, are held in a supercooled state. Therefore, a situation in which the bottled beverage P not in a supercooled state is sold is prevented. Moreover, the entire cooling operation is executed in a state in which the lower space temperature T1 is maintained within the range of the set temperature range TS, and thus, it is possible to put, in a supercooled state or a state close thereto, the bottled beverages P other than the bottled beverages P located on the lower side. Thus, for example, the situation that the bottled beverage P not in a supercooled state is sold is prevented even in a case in which sales of the bottled beverages P is in an excellent condition.

Moreover, in the present embodiment, the switching between the partial cooling operation and the entire cooling operation is made by reversing the rotation direction of the single internal blower fan 8. Thus, it is easy to make the switching between the partial cooling operation and the entire cooling operation, and furthermore, cost increase of the automatic vending machine 1 due to, for example, an increase in the number of components, is prevented.

Next, modified examples of the embodiment described above will be described. Note that, however, modified examples are not limited to Modified Examples 1 to 4 described below.

Modified Example 1

In the embodiment described above, the control unit 30 executes the entire cooling operation following the partial cooling operation, although the present invention is not limited thereto. The control unit 30 may execute the entire cooling operation independently from the partial cooling operation. For example, the control unit 30 executes the partial cooling operation when the lower space temperature T1 becomes higher than the upper-limit value $TS_u$ of the set temperature range TS, and ends the partial cooling operation (stops the cooling device 20) when the lower space temperature T1 is decreased to the lower-limit value $TS_L$ of the set temperature range TS. Furthermore, the control unit 30 executes the entire cooling operation at a given timing when the lower space temperature T1 is within the set temperature range TS. Also in this case, the control unit 30 stops the entire cooling operation to execute the partial cooling operation when the lower space temperature T1 becomes higher than the upper-limit value $TS_u$ of the set temperature range TS during the execution of the entire cooling operation. Moreover, the control unit 30 ends the entire cooling operation (ends the cooling device 20) when the lower space temperature T1 is decreased to the lower-limit value $TS_L$ of the set temperature range TS.

Modified Example 2

In the embodiment described above, the control unit 30 stops the entire cooling operation to execute the partial cooling operation when the lower space temperature T1 inside the product storage chamber 2 exceeds the upper-limit value $TS_u$ of the set temperature range TS during the execution operation of the entire cooling operation, although the invention is not limited thereto. The control unit 30 may stop the entire cooling operation to execute the partial cooling operation when there is a possibility that the lower space temperature T1 inside the product storage chamber 2 exceeds the upper-limit value $TS_u$ of the set temperature range TS during the execution of the entire cooling operation. The same applies to Modified Example 1.

For example, the control unit 30 is capable of monitoring an increased value (increase width) ΔT1 of the lower space temperature T1 inside the product storage chamber 2 at a predetermined time, and when the increased value ΔT1 is equal to or greater than a determined value dTS, determining that there is a possibility that the lower space temperature T1 inside the product storage chamber 2 exceeds the upper-limit value $TS_u$ of the set temperature range TS. In this case, the control unit 30 may execute the flowchart illustrated in FIG. 5 instead of the flowchart illustrated in FIG. 4.

Figure 5:
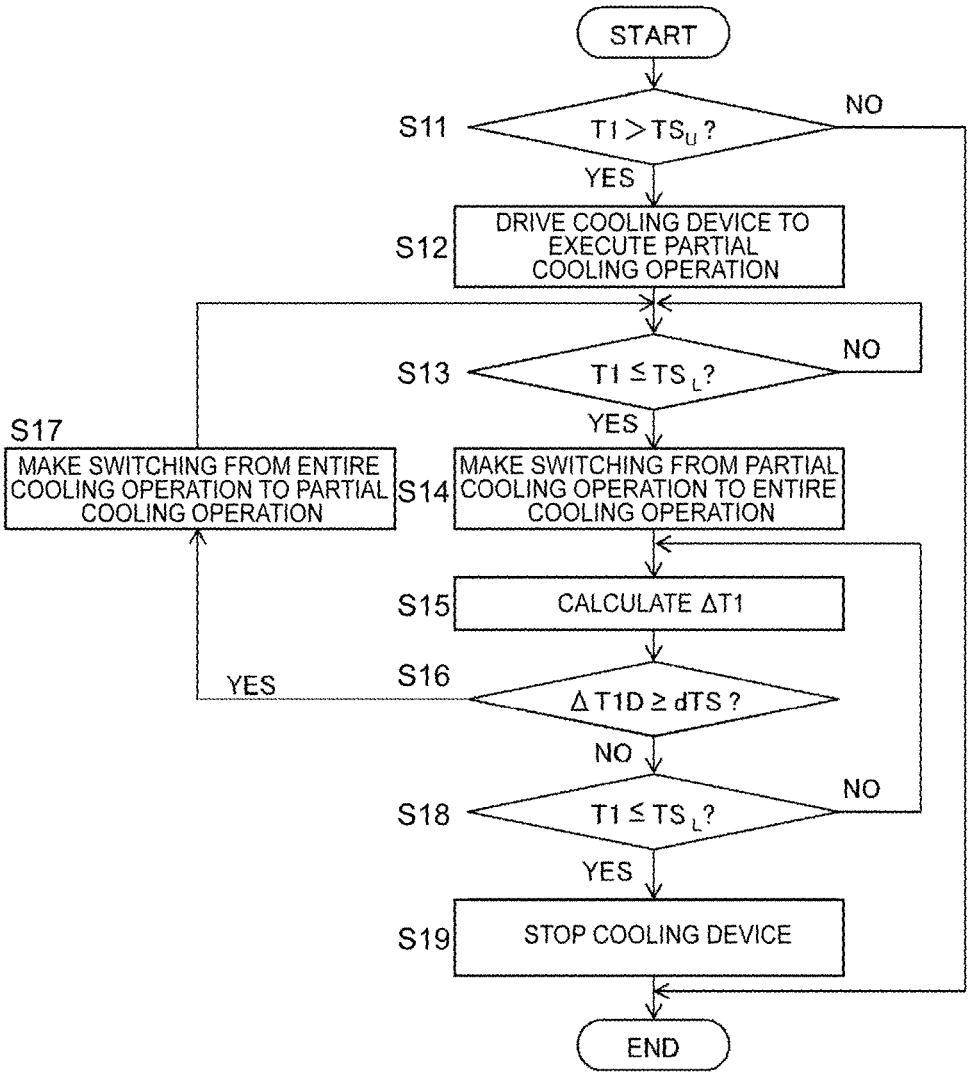
FIG. 5 is a flowchart illustrating another example of the operation control of the cooling device.

In FIG. 5, steps S11 to S14 are same as steps S1 to S4 of FIG. 4. In step S15, the control unit 30 calculates the increased value ΔT1 of the lower space temperature T1 inside the product storage chamber 2 at the predetermined time. The control unit 30 calculates, for example, a difference ($T1_n$–$T1_{n-1}$) between a current increased value $T1_n$ of the lower space temperature T1 and a previous value $T1_{n-1}$ thereof as the increased value ΔT1.

In step S16, the control unit 30 determines whether or not the increased value ΔT1 of the lower space temperature T1 calculated in step S15 is equal to or greater than the determined value dTS. Then the process proceeds to step S17 when the increased value ΔT1 is equal to or greater than the determined value dTS, and proceeds to step S18 when the increased value ΔT1 is less than the determined value dTS. Here, the determined value dTS may variably be set based on outside air temperature. Note that steps S17 to S19 are same as steps S6 to S8 of FIG. 4. Modified Example 2 also provides the same effects as effects provided by the embodiment described above.

Modified Example 3

Figure 6:
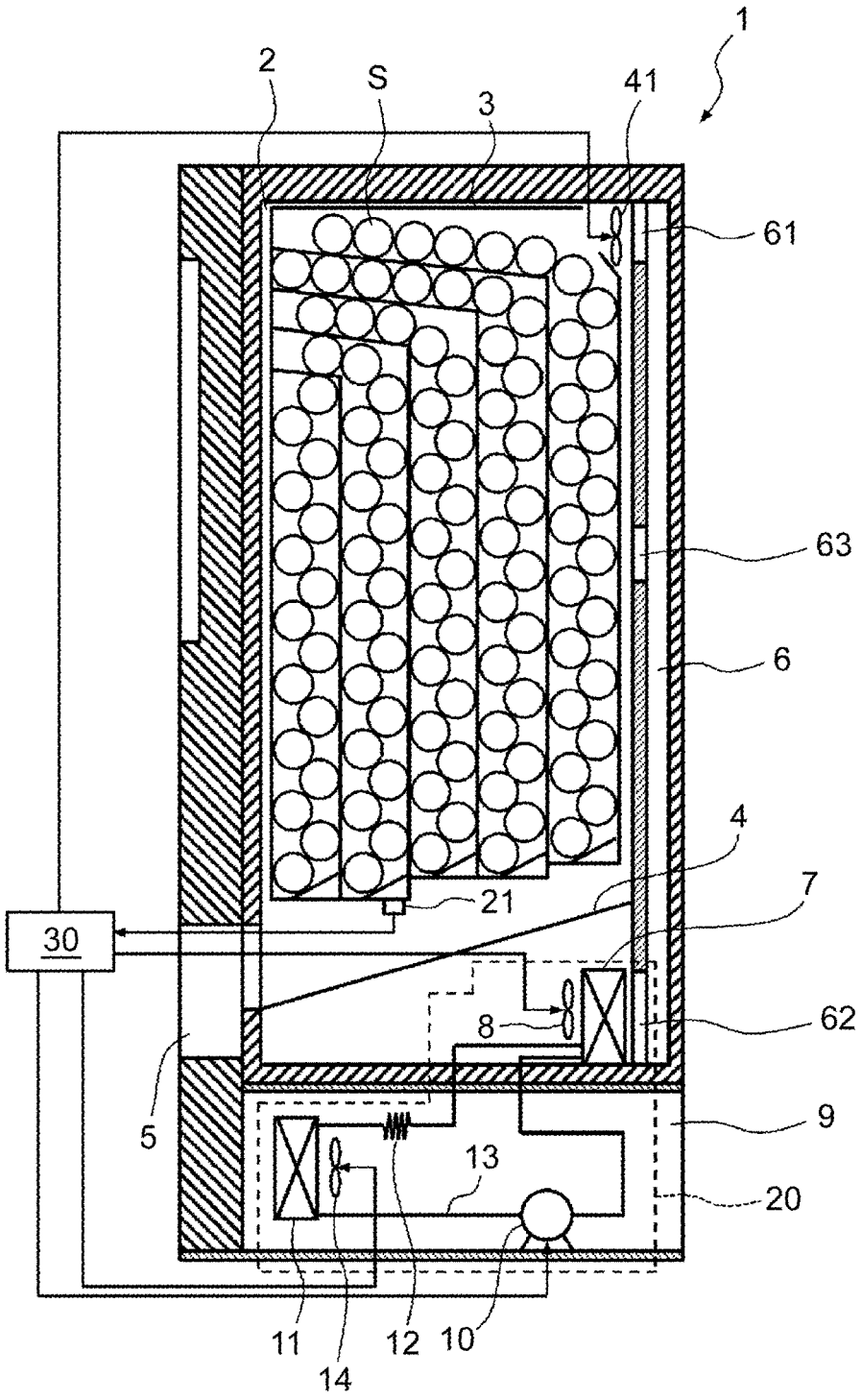
FIG. 6 is a side sectional view of an automatic vending machine according to a modified example.

In the embodiment described above, the single internal blower fan 8 is provided as a circulating fan which circulates the air inside the product storage chamber 2. However, the present invention is not limited thereto, and an additional internal blower fan 41 may be provided inside the product storage chamber 2. In this case, as illustrated in FIG. 6, the additional internal blower fan 41 is preferably provided in a vicinity of the upper opening part 61 of the back-side duct 6. Here, the additional internal blower fan 41 is a fan which sends airflow from a back side towards a front side of the product storage chamber 2.

To execute the entire cooling operation in Modified Example 3, the control unit 30 drives the internal blower fan 8 to rotate in a reverse direction and, in addition, actuates the additional internal blower fan 41. More specifically, the control unit 30 drives the internal blower fan 8 into reverse rotation and also actuates the additional internal blower fan 41 in step S4 of FIG. 4 or step S14 of FIG. 5, drives the internal blower fan 8 into normal rotation and also stops the additional internal blower fan 41 in step S7 of FIG. 4 or step S17 of FIG. 5, and stops the internal blower fan 8, the additional internal blower fan 41, the compressor 10, and the external blower fan 14 in step S8 of FIG. 4 or step S19 of FIG. 5. Modified Example 3 also provides the same effects as the effects provided by the embodiment described above.

Modified Example 4

Figure 7:
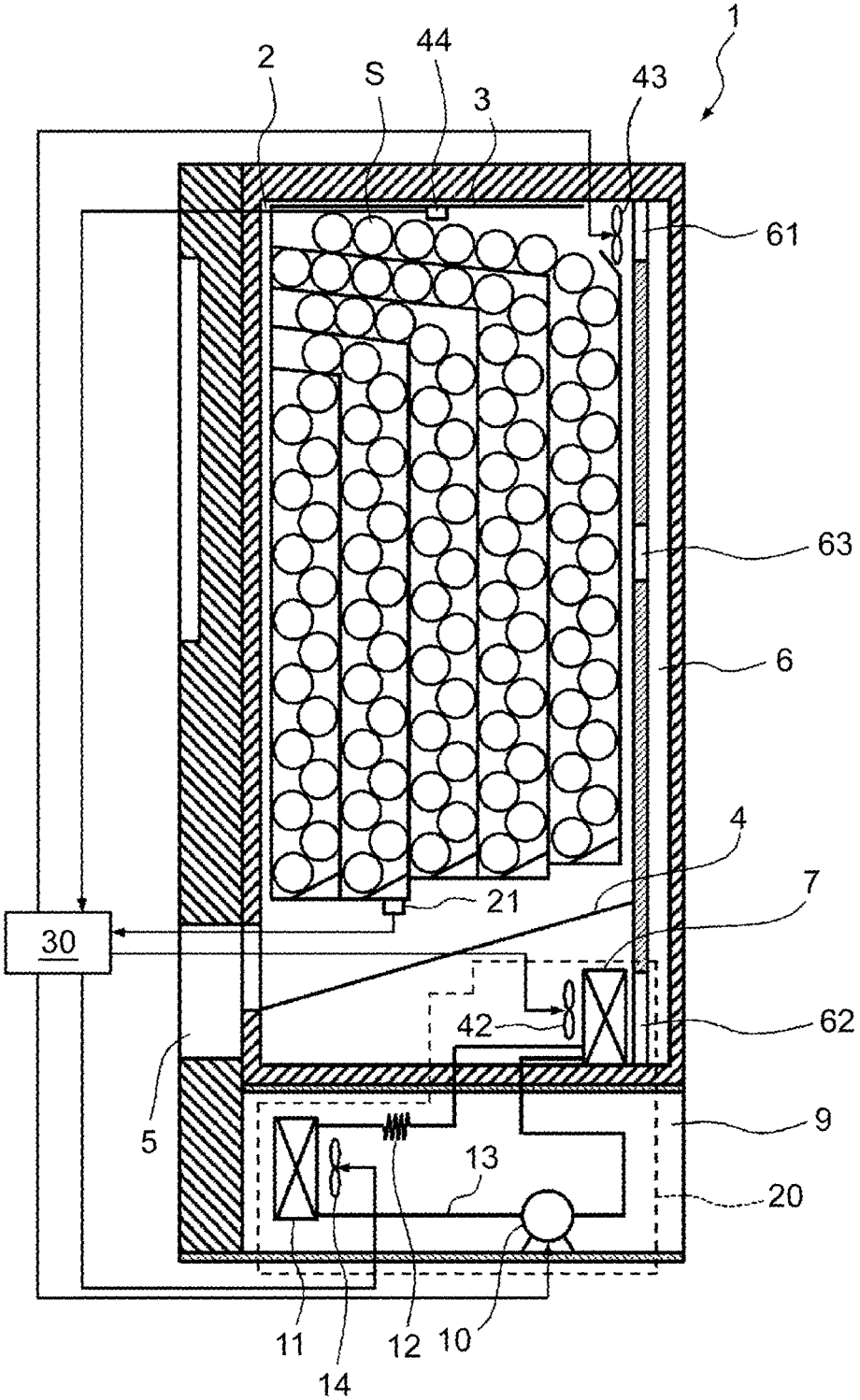
FIG. 7 is a side sectional view of an automatic vending machine according to another modified example.

In the embodiment described above (see FIGS. 2 and 3), a circulation direction of the air inside the product storage chamber 2 is reversed between when the partial cooling operation is performed and when the entire cooling operation is performed. However, the present invention is not limited thereto, and the circulation direction of the air inside the product storage chamber 2 may be the same for the partial cooling operation and the entire cooling operation. In this case, as illustrated in FIG. 7, for example, the internal blower fan 8 and the additional internal blower fan 41 in Modified Example 2 described above (FIG. 6) are respectively replaced with a lower internal blower fan 42 and an upper internal blower fan 43. The lower internal blower fan 42 is a fan which sends airflow from the back side towards the front side of the product storage chamber 2, and the upper internal blower fan 43 is a fan which sends airflow from the front side towards the back side of the product storage chamber 2.

Furthermore, a second temperature sensor (temperature measuring unit) 44 is provided at a ceiling part of the product storage device 3 in Modified Example 4 (see FIG. 7). However, the second temperature sensor 44 is only required to directly or indirectly measure a temperature of the upper space (upper space temperature T2) inside the product storage chamber 2, and an installation position of the second temperature sensor 44 is not limited to the ceiling part of the product storage device 3. For example, the second temperature sensor 44 may be provided in the back-side duct 6, more specifically, above the middle opening part 63 inside the back-side duct 6. Then the control unit 30 reads in, at a predetermined cycle, the lower space temperature T1 inside the product storage chamber 2 measured by the temperature sensor 21 and the upper space temperature T2 inside the product storage chamber 2 measured by the second temperature sensor 44.

Figure 8:
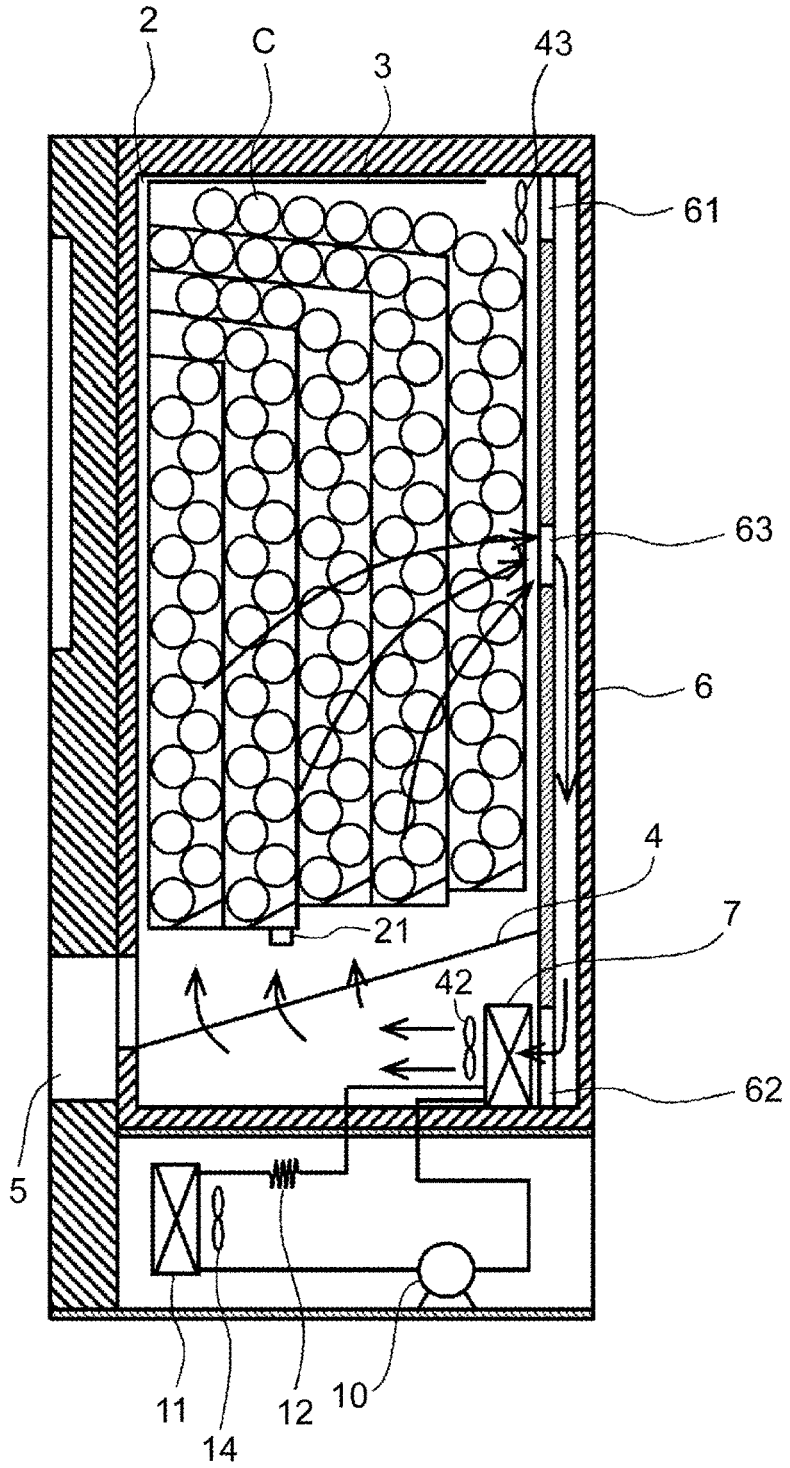
FIG. 8 is a view illustrating an air flow inside the product storage chamber upon the partial cooling operation performed in the automatic vending machine according to the another modified example.

To execute the partial cooling operation in Modified Example 4, the control unit 30 actuates the lower internal blower fan 42, the compressor 10, and the external blower fan 14. Then, as illustrated in FIG. 8, the air inside the product storage chamber 2 circulates through the inside of the product storage chamber 2 so as to flow into the back-side duct 6 from the middle opening part 63, downwardly pass through the inside of the back-side duct 6, flow out from the lower opening part 62, and then flow into the back-side duct 6 from the middle opening part 63 again, to be cooled.

Figure 9:
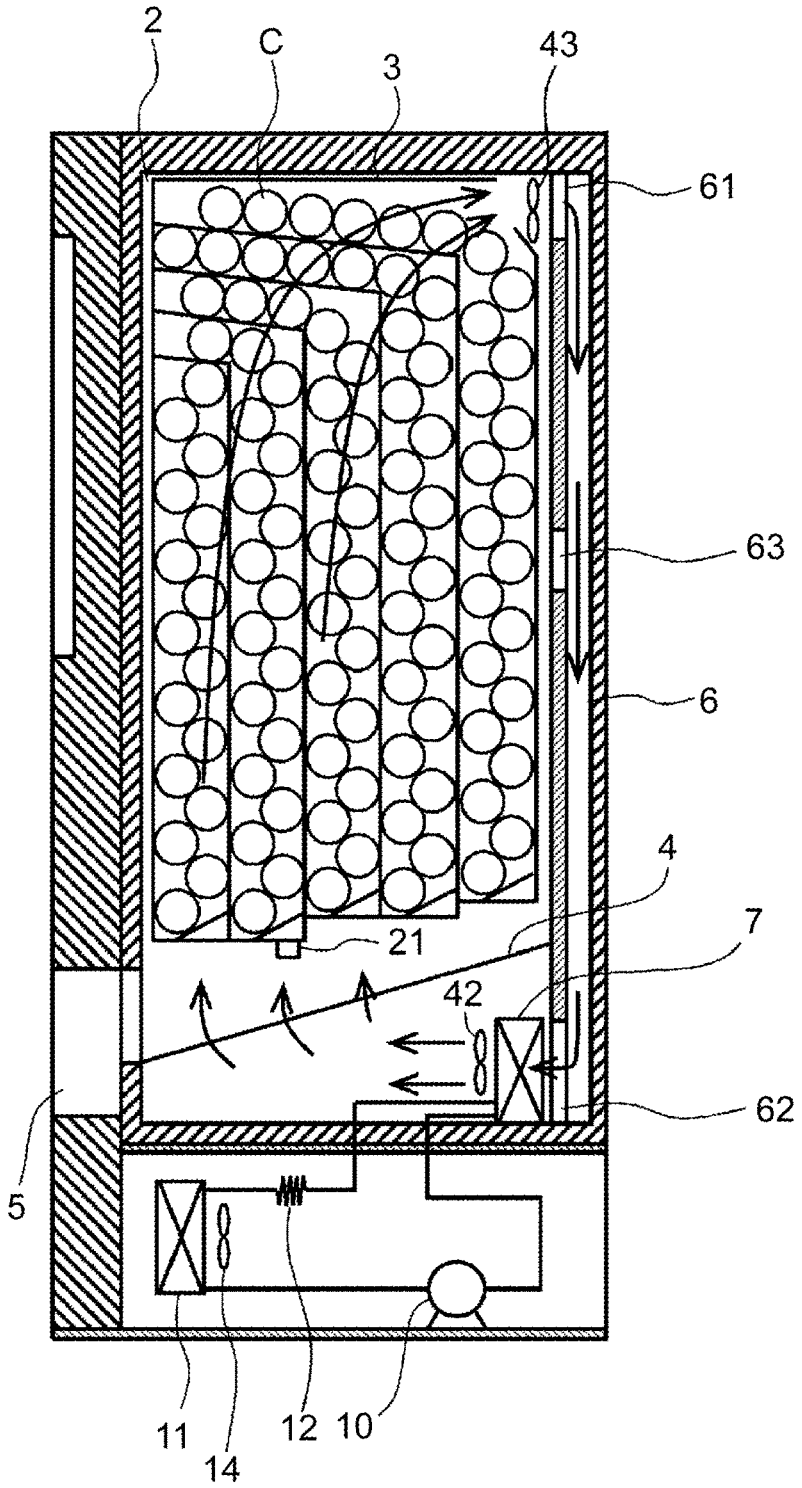
FIG. 9 is a view illustrating an air flow inside the product storage chamber upon the entire cooling operation performed in the automatic vending machine according to the another modified example.

Furthermore, to execute the entire cooling operation in Modified Example 4, the control unit 30 actuates the lower internal blower fan 42, the upper internal blower fan 43, the compressor 10, and the external blower fan 14. Then, as illustrated in FIG. 9, the air inside the product storage chamber 2 circulates through the inside of the product storage chamber 2 so as to flow into the back-side duct 6 from the upper opening part 61, downwardly pass through the inside of the back-side duct 6, flow out from the lower opening part 62, and then flow into the back-side duct 6 from the upper opening part 61 again, to be cooled.

Figure 10:
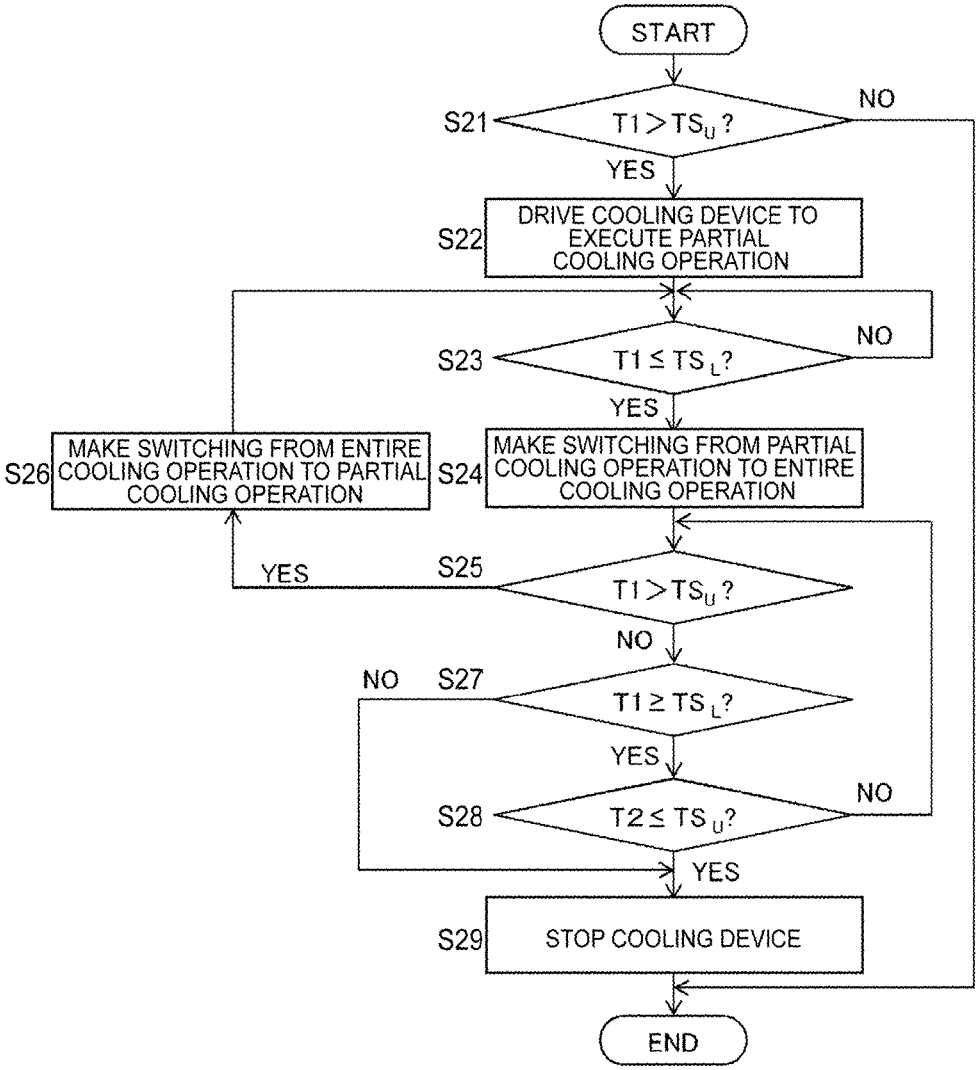
FIG. 10 is a flowchart illustrating one example of the operation control of the cooling device performed by the automatic vending machine according to the another modified example.

Then the control unit 30 runs as in a flowchart illustrated in FIG. 10 instead of the flowchart illustrated in FIG. 4. Steps S21 to S26 in FIG. 10 are the same as steps S1 to S6 of FIG. 4. However, the control unit 30 actuates the lower internal blower fan 42, the compressor 10, and the external blower fan 14 in step S22, further actuates the upper internal blower fan 43 in step S24, and stops the actuated upper internal blower fan 43 in step S26.

The control unit 30 determines in step S27 whether or not the lower space temperature T1 inside the product storage chamber 2 is equal to or greater than the lower-limit value $TS_L$ of the set temperature range TS. The process proceeds to step S28 when the lower space temperature T1 is equal to or greater than the lower-limit value $TS_L$ of the set temperature range TS, and proceeds to step S29 when the lower space temperature T1 is less than the lower-limit value $TS_L$ of the set temperature range TS. Note that process of step S27 is executed for the purpose of preventing excessive cooling of the lower space inside the product storage chamber 2, and more specifically, the bottled beverages P stored on the lower side in each product storage column of the product storage device 3.

In step S28, the control unit 30 determines whether or not the upper space temperature T2 inside the product storage chamber 2 is decreased to the upper-limit value $TS_u$ of the set temperature range TS. The process proceeds to step S29 when the upper space temperature T2 is decreased to the upper-limit value $TS_u$ of the set temperature range TS and proceeds to step S27 when the upper space temperature T2 exceeds the upper-limit value $TS_u$ of the set temperature range TS.

The control unit 30 stops the cooling device 20 in step S29. More specifically, the control unit 30 stops the lower internal blower fan 42, the upper internal blower fan 43, the compressor 10, and the external blower fan 14.

Modified Example 4 also provides the same effects as the effects provided by the embodiment described above. Furthermore, Modified Example 2 may be applied to Modified Example 4, in this case, step S25 of FIG. 10 may be replaced with steps S15 and S16 of FIG. 5. Furthermore, in Modified Example 4, the control unit 30 stops the cooling device 20 when the upper space temperature T2 is decreased to the upper-limit value $TS_u$ of the set temperature range TS; however, a predetermined stop determination temperature for stopping the cooling device 20 may be used instead of the upper-limit value $TS_u$ of the set temperature range TS. Note that it is possible to define the stop determination temperature as a temperature higher than the upper-limit value $TS_u$ of the set temperature range TS.

Hereinabove, although the embodiments of the present invention and the modified examples thereof have been described, the present invention is not limited to the above-mentioned embodiments and modified examples, and can be variously modified and changed based on the technical concept of the present invention. For example, the above-mentioned embodiments and the modified examples, are directed to automatic vending machines which sells bottled beverages in a supercooled state as products; however, the present invention is widely applicable to automatic vending machines which cool products for sale.

REFERENCE SYMBOL LIST

1 automatic vending machine
2 product storage chamber
3 product storage device
6 back-side duct
7 internal heat exchanger
8, 41 to 43 internal blower fan (circulating fan)
10 compressor
11 external heat exchanger
12 expansion mechanism
14 external blower fan
20 cooling device
21 temperature sensor (lower part temperature measuring unit)
30 control unit (control section)
44 second temperature sensor (upper part temperature measuring unit)
61 upper opening part
62 lower opening part
63 middle opening part
P bottled beverage (product)

The invention claimed is:

1. An automatic vending machine which vertically arrays and stores a plurality of products inside a product storage chamber and sequentially dispenses the products starting with the product located at a lowermost part, the automatic vending machine comprising:

a cooling device which cools the inside of the product storage chamber;

a lower part temperature measuring unit which measures a temperature of a lower space inside the product storage chamber;

a control unit which controls operation of the cooling device, and is able to selectively executes partial cooling operation for cooling the product located on a lower side of the plurality of products and entire cooling operation for cooling all the plurality of products; and a back-side duct which is disposed inside the product storage chamber on a back side thereof and extends heightwise of the product storage chamber, wherein when the temperature of the lower space inside the product storage chamber becomes higher than a set temperature range, the control unit executes the partial cooling operation to maintain the temperature of the lower space inside the product storage chamber within the set temperature range, the cooling device is configured so as to cool the plurality of products by cooling air inside the product storage chamber while circulating the air through the back-side duct, a circulation direction of the air inside the product storage chamber is the same for the partial cooling operation and the entire cooling operation, the back-side duct has: an upper opening part which opens at an upper part inside the product storage chamber; a lower opening part which opens at a lower part inside the product storage chamber; and a middle opening part which opens at a middle part between the upper part and the lower part inside the product storage chamber, the cooling device includes: a cooler which is disposed in a vicinity of the lower opening part of the back-side duct and cools ambient air; a first circulating fan which is disposed in a vicinity of the cooler; and a second circulating fan which is disposed in a vicinity of the upper opening part of the back-side duct, the air inside the product storage chamber circulates in the partial cooling operation so as to flow into the back-side duct from the middle opening part, pass through the back-side duct, flow out from the lower opening part, and thereafter flow into the back-side duct from the middle opening part again, the air inside the product storage chamber circulates in the entire cooling operation so as to flow into the back-side duct from the upper opening part, pass through the back-side duct, flow out from the lower opening part, and thereafter flow into the back-side duct from the upper opening part again, and the control unit drives only the first circulating fan in the partial cooling operation and drives the first circulating fan and the second circulating fan in the entire cooling operation.

2. The automatic vending machine according to claim 1, wherein the control unit makes switching from the partial cooling operation to the entire cooling operation after the temperature of the lower space inside the product storage chamber is decreased to the set temperature range due to the execution of the partial cooling operation.

3. The automatic vending machine according to claim 1, wherein the control unit stops the entire cooling operation to execute the partial cooling operation when the temperature of the lower space inside the product storage chamber becomes higher than the set temperature range during the execution of the entire cooling operation or when there is a possibility that the temperature of the lower space inside the product storage chamber becomes higher than the set temperature range during the execution of the entire cooling operation.

4. The automatic vending machine according to claim 1, wherein the products are bottled beverages, and the set temperature range is a temperature range in which the bottled beverages are in a supercooled state.

* * * * *